United States Patent [19]

Oda

[11] 4,422,220

[45] Dec. 27, 1983

[54] AUTOMATIC LOCK SLIDER FOR SLIDE FASTENERS

[75] Inventor: Kiyoshi Oda, Namerikawa, Japan

[73] Assignee: Yoshida Kogyo K. K., Tokyo, Japan

[21] Appl. No.: 351,745

[22] Filed: Feb. 24, 1982

[30] Foreign Application Priority Data

Feb. 25, 1981 [JP] Japan ..... 56-25510

[51] Int. Cl.[3] ..... A44B 19/30

[52] U.S. Cl. ..... 24/421

[58] Field of Search ..... 24/205.14 R, 205.15 A, 24/205.14 K

[56] References Cited

U.S. PATENT DOCUMENTS

| | | | |
|---|---|---|---|
| 2,048,636 | 7/1936 | Kotowski | 24/205.14 R |
| 2,654,931 | 10/1953 | Voity | 24/205.14 R |
| 3,133,328 | 5/1964 | Huelster | 24/205.14 R |
| 3,368,249 | 2/1968 | Fukuroi | 24/205.14 R |
| 3,952,379 | 4/1976 | Fukuroi | 24/205.14 R |
| 4,074,399 | 2/1978 | Kedzierski | 24/205.14 R |
| 4,081,883 | 4/1978 | Ishii et al. | 24/205.14 R |
| 4,139,928 | 2/1978 | Aoki et al. | 24/205.14 R |

*Primary Examiner*—Robert P. Swiatek
*Assistant Examiner*—Kris R. Schulze
*Attorney, Agent, or Firm*—Hill, Van Santen, Steadman & Simpson

[57] ABSTRACT

An automatically locking slider for slide fasteners has a locking member including a piece of resilient strip which is bent into a generally "3" or "E" shape having a U-shaped base extending around a transverse spindle of a pull tab, a locking prong extending from one end of the base, and an anchor extending from the other end of the base and terminating in a recessed end interlocked with a locking-member retaining-nose on a neck of a slider body. The base is normally urged against the spindle of the pull tab by the resilience of the strip. The recessed end of the anchor is normally urged against the nose by the resilience of the strip and is thereby prevented from coming out of interlocking engagement with the nose. Thus the locking member is held in position on the slider body solely by the resilience of the strip, requiring no bending or deformation of any part of the slider body that would make the slider defective from an aesthetic view.

5 Claims, 9 Drawing Figures

AUTOMATIC LOCK SLIDER FOR SLIDE FASTENERS

BACKGROUND OF THE INVENTION

1. Field of the Invention

The present invention relates to an automatically locking slider for slide fasteners.

2. Prior Art

U.S. Pat. No. 4,139,928 issued Feb. 20, 1978 discloses an automatically locking slider for slide fasteners in which a locking member comprises a piece of resilient strip, usually made of steel. The locking member has at one end a locking prong and at the other end an anchoring portion. The anchoring portion extends into a clamping groove in a slider's neck and terminates in a laterally recessed end which is retained by a pair of clamping lugs, one on each sidewall of the groove. This retaining is accomplished by bending or otherwise deforming the lugs together with part of the sidewalls around the recessed end. A problem experienced with the prior slider is that a coating of the slider body is apt to easily come off during the bending or deforming operation, making the slider defective from an aesthetic view and leading to increased rate of corrosion as well. Coating or plating of the slider after assembling would adhere the locking member locally to the slider body, hindering smooth pivotal movement of the locking member.

SUMMARY OF THE INVENTION

A locking member includes a resilient strip having a U-shaped base extending around a transverse spindle of a slider pull tab, a locking prong extending from one end of the base, and an anchor extending from the other end of the base and terminating in a laterally recessed end interlocked with a locking-member retaining-nose on a slider's neck. The base is normally urged against the spindle of the pull tab by the resilience of the strip. The recessed end of the anchor is urged against the nose by the resilience of the strip and is thereby prevented from coming out of interlocking engagement with the retaining nose. Thus, the locking member is held in position on a slider body solely by the resilience of the strip, requiring no bending or deformation of any part of the slider body.

It is an object of the present invention to provide an automatically locking slider for slide fasteners which can be assembled without bending or deformation of any part of a slider body, usually coated or plated before assembling.

Another object of the present invention is to provide an automatically locking aliser for slide fasteners which can be assembled easily and less costly.

Another object of the present invention is to provide an automatically locking slider for slide fasteners which comprises a locking member durable in structure and reliable in operation.

Many other advantages, features and additional objects of the present invention will become manifest to these versed in the art upon making reference to the detailed description and the accompanying drawings in which a preferred embodiment incorporating the principles of the present invention is shown by way of illustrative example.

DETAILED DESCRIPTION OF THE PREFERRED EMBODIMENT

Figure 1:
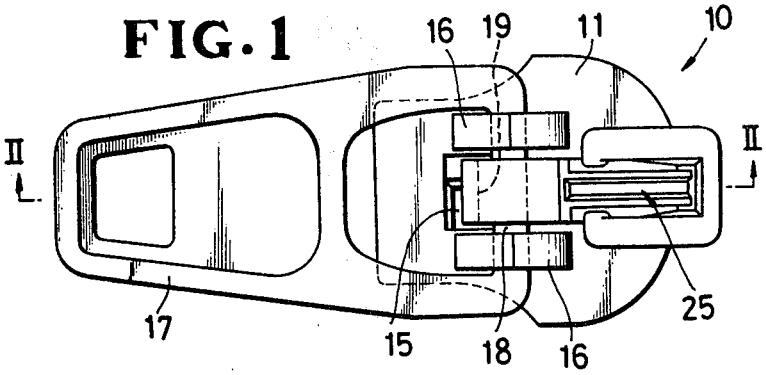
FIG. 1 is a plan view of an automatically locking slider for slide fasteners according to the present invention.

The principles of the present invention are particularly useful when embodied in an automatically locking slider (herein referred to as "slider") such as shown in FIGS. 1, 2 and 7–9, generally indicated by the numeral 10.

The slider 10 comprises a slider body including a pair of flanged first and second (upper and lower) wings 11,12 joined at one end by a neck 13 so as to define a generally Y-shaped guide channel 14 between the wings 11,12 for the passage of a pair of coupling element rows of a slide fastener (not shown). The first wing 11 has an aperture 15 communicating with the guide channel 14. The first wing 11 further has a pair of laterally spaced lugs 16,16 one on each side of the aperture 15. A pull tab 17 has a transverse spindle 18 journaled by the lugs 16,16 and is hence pivotable on the first wing 11. The transverse spindle 18 has an eccentric cam 19 having a shape obtained by removing a smaller segment from a circle, for a purpose described below.

The neck 13 has a longitudinally (vertically) extending hole 20. The hole 20 has a rectangular cross section and is defined by a pair of opposed front and rear (second and first) walls 21,22 and a pair of opposed unnumbered sidewalls. A locking-member retaining nose 23 (FIG. 4) projects from the rear (first) wall 22 and is disposed adjacent to one end of the hole 20 (FIG. 2) which opens into the second wings 12. The rear wall 22 has a slope **22*a* (FIG. 4) extending from the other end of the hole 20 to a tip 23*a* of the retaining nose 23, for a purpose described below. The rear wall 22 further has a groove 24 extending centrally longitudinally thereof across the retaining nose 23 and communicating with the hole 20, whereby the slope comprises a pair of laterally spaced cam surfaces. The retaining nose 23 is separated at the center by the groove 24** to form transverse abutments.

Figure 2:
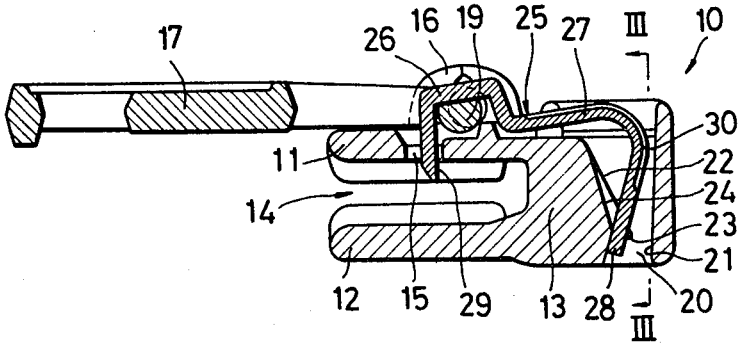
FIG. 2 is a cross-sectional view taken along the line II—II of FIG. 1, showing a locking member of the slider in locking position.

A locking member 25 includes a resilient strip, preferably made of stainless steel, which is bent generally into a "3" or "E" shape having a U-shaped base 26, an anchor 27 extending from one end of the base 26 and terminating in a laterally recessed end 28 interlocked with the retaining nose 23, and a locking prong 29 extending from the other end of the base 26 for normally projecting into the guide channel 14 through the aperture 15 as shown in FIG. 2.

The base 26 of the locking member 25 extends around the transverse spindle 18 of the pull tab 17 and is normally urged to rest against a flat surface of the cam 19 by the resilience of the strip (25). The cam 19 is angularly movable, in response to the pivotal movement of the pull tab 17, to raise the base 26 away from the first wing 11, causing the locking prong 29 to be retracted from the guide channel 14 into the aperture 15 as progressively shown in FIGS. 7–9.

Figure 4:
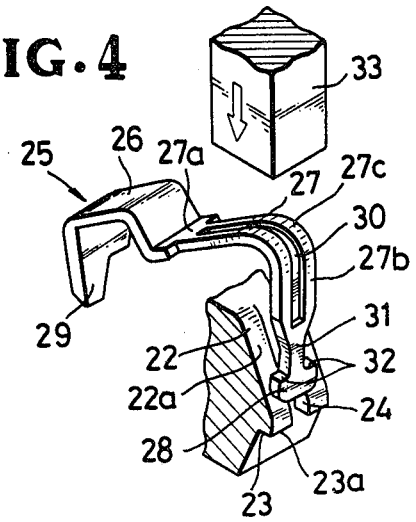
FIG. 4 is a perspective view of the locking member shown in position ready for assembling onto a slider body.

The anchor 27 of the locking member 26 has a "dogleg" shape including a first portion 27*a* (FIG. 4) extending over and at an angle to the first wing 11, a second section 27*b* extending from a knee 27*c* of such a dogleg shape into the hole 20. As best shown in FIG. 4, the anchor 27 has an elongated recess 30 formed by cold pressing and extending along a substantial length of the first and second sections 27*a*,27*b* across the knee 27*c*. The anchor 27 is thus of a high cold rolled modulus in a region adjacent to the elongated recess 20 for facilitating the bending or other shaping of the blank of the strip (25) and at the same time affording increased resilience and strength to the locking member 25.

Figure 3:
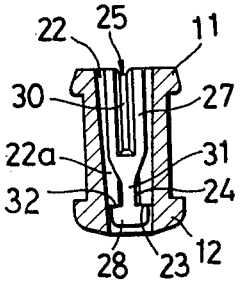
FIG. 3 is a cross-sectional view taken along the line III—III of FIG. 2.

The recessed end 28 of the anchor 27 includes a reduced shank 31 and a laterally elongated ankle having a pair of shoulders 32,32 one on each side of the shank 31. As shown in FIG. 3, the shank 31 is snugly received in the groove 24 in the sloped rear wall 22 against lateral displacement, and the shoulders 32,32 lockingly engage with the centrally spaced nose 23 by the resilience of the strip (25) and is thereby prevented from coming out of interlocking engagement with the retaining nose 23. The recessed end 28 is formed as an extension of the second section 27*b* of the dogleg-shaped anchor 27 and is not bent into an "L" or hook shape. The hole 20 in the slider neck 13 can therefore be reduced in size to such an extent that the tip 23*a* of the nose 23 and the front wall 21 of the hole 20 is spaced by a distance substantially equal to or slightly greater than the thickness of the strip (25), making slider body rigid and compact.

The knee 27*c* of the dogleg-shaped anchor 27 is spaced from the front (first) wall 21 of the hole 21 so that the base 26 of the locking member 25 is angularly movable substantially about the knee 27*c* as the base 26 is raised away from the first wing 11 by the pull tab 17. As an alternative, the locking member 25 may be so formed that, when mounted on the slider body, the knee 27*c* of the dogleg-shaped anchor 27 touches with the front wall 21 of the hole 20, and the pivoting takes place about the knee 27*c*.

Figure 5:
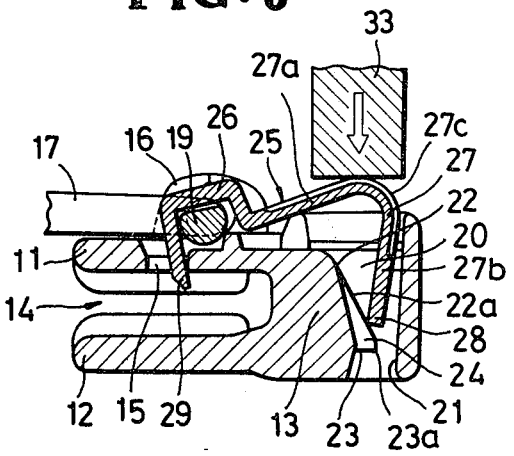
FIGS. 5 and 6 are cross-sectional views corresponding to FIGS. 2 and 3, respectively, but showing the manner in which the locking member is mounted on the slider body.
Figure 6:
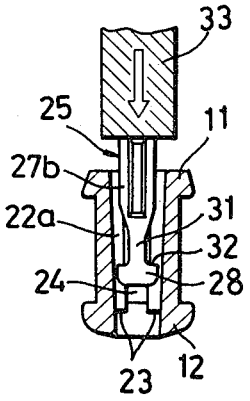

For assembly, the locking member 25 is so formed that its shape in its free form (FIGS. 4–6) is somewhat distorted to the shape of FIG. 2 by having been mounted on the slider body. The locking member 25 is placed on the slider body as shown in FIGS. 4–6. As that time, the second anchor section 27*b* projects into the hole 20, and the recessed anchor end 28 touches the sloped rear wall 22 and terminates short of the tip 23*a* of the retaining nose 23 (FIGS. 4 and 5). The U-shaped base 26 rests on the flat surface of the cam 19 of the pull tab spindle 18 such that the locking prong 29 projects into or through the aperture 15. Then the locking member 25 is pressed at the first anchor section 27*a* downwardly toward the first wing 11 by a punch or press 33, causing the recessed end 28 of the anchor 27 to slide downwardly on and along the slope 22*a* during which time the angled anchor 27 is deflected so as to store resilient energy in the locking member 25. As a result the recessed anchor end 28 is snapped into interlocking engagement with the retaining nose 23.

By this resilience the U-shaped base 26 and the shoulders 32 of the recessed end 28 are normally urged against the cam 19 and the retaining nose 23, respectively, preventing the locking member 25 from being removed from the slider body. The shank 31 of the recessed anchor end 28 is snugly received in the groove 24 in the rear wall 22, preventing lateral displacement of the locking member 25.

In operation, the pull tab 17 lies on the first wing 11 over the rear end as shown in FIG. 2, the locking member 25 is in the locking position in which the locking prong 29 projects through the aperture 15 into the guide channel 14 to lockingly engage with a pair of coupling element rows of a slide fastener (not shown). At that time, the base 26 of the locking member 25 is in lowered position.

Figure 7:
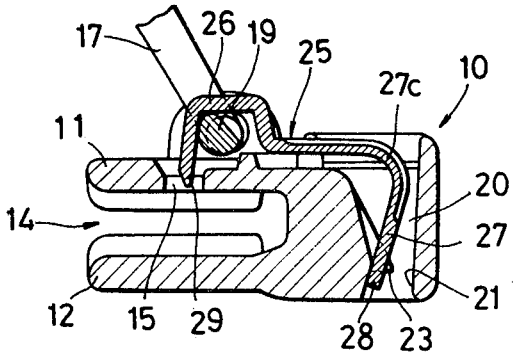
FIGS. 7 to 9 inclusive are fragmentary cross-sectional views showing the locking member out of locking position.

When the pull tab 17 is pivotally moved from the position of FIG. 2 to the position of FIG. 7, the base 26 of the locking member 25 is raised by the eccentric cam 19 against the bias of the strip (25), causing the locking prong 29 to be retracted from the guide channel 14 into the aperture 15 to release the pair of fastener coupling elements rows (not shown).

Figure 8:
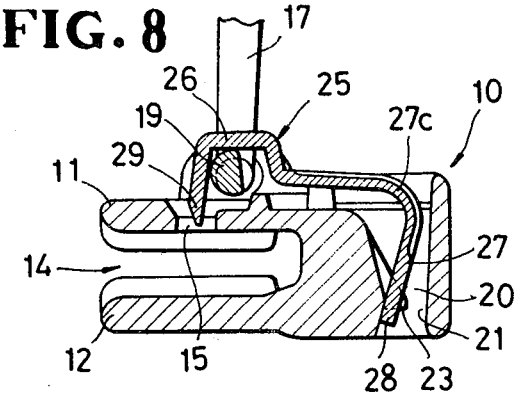

When the pull tab 17 is further moved angularly from the position of FIG. 7 to the position of FIG. 8, i.e. upright position, the eccentric cam 19 further raises the base 26 against the bias of the strip (25), by contacting at a peak thereof with the base 26. The locking prong 29 is therefore brought into its highest or fully retracted position.

Figure 9:
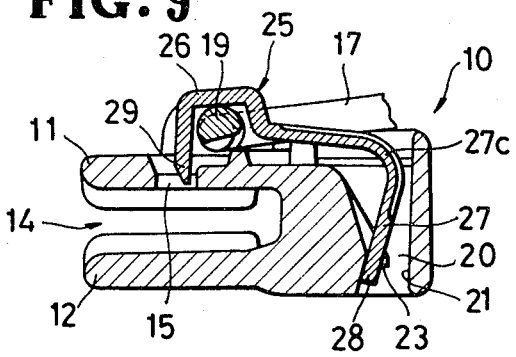

With continued pivotal movement of the pull tab 17, from the position of FIG. 8 to the position of FIG. 9, in which the pull tab 17 lies on the first wing 11 over the front end, no substantial movement of the locking member 25 is effected; that is, although the locking prong 29 slightly moves downwardly toward the guide channel 14, the locking member 25 is maintained out of the locking position.

In this embodiment, since the knee 27*c* of the dogleg-shaped anchor 27 is spaced from the front wall 21 of the hole 20, the base 26 of the locking member 25 is angularly movable about the recessed end 28.

Although various minor modifications may be suggested by those versed in the art, it should be understood that I wish to embody within the scope of the patent warranted hereon, all such embodiments as reasonably and properly come within the scope of my contribution to the art.

What is claimed is:

1. An automatically locking slider for a slide fastener having a pair of coupling element rows, said slider comprising:

(a) a slider body including a pair of first and second wings joined at one end by a neck so as to define therebetween a generally Y-shaped guide channel for the passage of the pair of coupling element rows, said first wing having an aperture communicating with said guide channel, said neck having a pair of laterally spaced cam surfaces extending from said first wing and each terminating in a transverse abutment to jointly define a locking-member retaining nose adjacent to said second wing;

(b) a pair of laterally spaced lugs on said first wing, one on each side of said aperture;

(c) a pull tab pivotably connected to said lugs and having a transverse spindle journaled thereby; and (d) a locking member pivotably supported on said slider body and including a resilient strip having (1) a U-shaped base extending around said transverse spindle and normally urged thereagainst by the resilience of said strip, said base being angularly movable away from said first wing in response to the pivotal movement of said pull tab against the bias of said strip, (2) an anchor extending from one end of said base and terminating in a shank having a pair of shoulders projecting from the distal end thereof, said shank lying between said cam surfaces, and said shoulders each being trapped by said abutments thereof within said neck, said distal end being urged against said nose by the resilience of said strip and thereby prevented from coming out of interlocking engagement with said nose, and (3) a locking prong extending from the other end of said base for normally projecting into said guide channel through said aperture to lockingly engage with a pair of coupling element rows, said locking prong being retractable from said guide channel into said aperture in response to the angular movement of said base away from said first wing.

2. A slider according to claim 1, said neck having a longitudinally extending hole having a pair of opposed first and second walls, said cam surfaces projecting from said first wall.

3. A slider according to claim 2, a tip of said abutment and said second wall being spaced by a distance slightly greater than the thickness of said resilient strip.

4. A slider according to claim 2, said anchor being spaced from said second wall of said hole, said base of said locking member being thereby pivotably movable substantially about said shoulders.

5. A slider according to claim 2, said anchor having an elongated recess formed by cold pressing and extending longitudinally substantially from said base to said shank, a region adjacent said recess having a relatively high cold rolled modulus.

* * * * *